US006605205B2

(12) United States Patent
Akram et al.

(10) Patent No.: US 6,605,205 B2
(45) **Date of Patent: *Aug. 12, 2003**

(54) METHOD FOR CONTINUOUS PROCESSING OF SEMICONDUCTOR WAFERS

(75) Inventors: Salman Akram, Boise, ID (US); David R. Hembree, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/901,793

(22) Filed: Jul. 9, 2001

(65) Prior Publication Data

US 2001/0052464 A1 Dec. 20, 2001

Related U.S. Application Data

(63) Continuation of application No. 09/528,523, filed on Mar. 20, 2000, now Pat. No. 6,277,262, which is a continuation of application No. 09/283,139, filed on Mar. 31, 1999, now Pat. No. 6,132,570, which is a continuation of application No. 08/901,601, filed on Jul. 24, 1997, now Pat. No. 5,893,966.

(51) Int. Cl.[7] ..... C25D 7/12

(52) U.S. Cl. ..... 205/123; 205/137; 205/138; 204/512

(58) Field of Search ..... 205/123, 137, 205/138; 204/512

(56) References Cited

U.S. PATENT DOCUMENTS

| | | | | |
|---|---|---|---|---|
| 2,495,695 A | | 1/1950 | Camin et al. | |
| 3,161,576 A | | 12/1964 | Teichner | |
| 3,161,578 A | | 12/1964 | Facquet et al. | |
| 3,522,087 A | | 7/1970 | Lacal | |
| 3,580,827 A | | 5/1971 | Lannegrace | |
| 3,714,011 A | | 1/1973 | Grosso et al. | 204/181 |
| 4,304,641 A | | 12/1981 | Grandia et al. | 204/23 |
| 4,592,816 A | | 6/1986 | Emmons et al. | 204/180.6 |
| 4,696,729 A | | 9/1987 | Santini | 204/224 R |
| 5,096,550 A | | 3/1992 | Mayer et al. | 204/129.1 |
| 5,198,089 A | | 3/1993 | Brueggman | 204/240 |
| 5,273,642 A | | 12/1993 | Crites et al. | 205/118 |
| 5,403,458 A | | 4/1995 | Hartig et al. | 204/192.15 |
| 5,421,987 A | | 6/1995 | Tzanavaras et al. | 205/133 |
| 5,437,777 A | | 8/1995 | Kishi | 204/224 R |
| 5,441,629 A | | 8/1995 | Kosaki | 205/148 |
| 5,447,615 A | | 9/1995 | Ishida | 204/224 R |
| 5,472,592 A | | 12/1995 | Lowery | |
| 5,516,412 A | | 5/1996 | Andricacos et al. | 204/224 R |
| 5,893,966 A | * | 4/1999 | Akram et al. | 205/137 |
| 6,277,262 B1 | * | 8/2001 | Akram et al. | 205/123 |

* cited by examiner

*Primary Examiner*—Kishor Mayekar
(74) *Attorney, Agent, or Firm*—TraskBritt

(57) ABSTRACT

An electrochemical reaction assembly and methods of inducing electrochemical reactions, such as for deposition of materials on semiconductor substrates. The assembly and method achieve a highly uniform thickness and composition of deposition material or uniform etching or polishing on the semiconductor substrates by retaining the semiconductor substrates on a moving cathode immersed in an appropriate reaction solution wherein a wire mesh anode rotates about the moving cathode during electrochemical reaction.

25 Claims, 5 Drawing Sheets

METHOD FOR CONTINUOUS PROCESSING OF SEMICONDUCTOR WAFERS

CROSS-REFERENCE TO RELATED APPLICATIONS

This application is a continuation of application Ser. No. 09/528,523, filed Mar. 20, 2000, now U.S. Pat. No. 6,277,262 B1, issued Aug. 21, 2001, which is a continuation of application Ser. No. 09/283,139, filed Mar. 31, 1999, now U.S. Pat. No. 6,132,570, issued Oct. 17, 2000, which is a continuation of application Ser. No. 08/901,601, filed Jul. 24, 1997, now U.S. Pat. No. 5,893,966, issued Apr. 13, 1999.

BACKGROUND OF THE INVENTION

1. Field of the Invention

The present invention relates to an apparatus and method for electrodepositing material on an article. More particularly, the present invention relates to continuously electrodepositing material on semiconductor components by retaining the components on a moving cathode immersed in an appropriate electrolyte wherein a wire mesh anode rotates about the moving cathode during electrodeposition.

2. State of the Art

Semiconductor wafers, substrates, and printed circuit boards (collectively hereinafter "semiconductor substrates") are often coated with various materials, such as metals, which are etched in later semiconductor fabrication processes to form components on the semiconductor substrates. Techniques for coating semiconductor substrates include electrodeposition, electron beam evaporator deposition, chemical vapor deposition, sputter deposition, and the like. Electrodeposition has become a commonly used technology.

Electrodeposition is a process which deposits a thin film of material, such as metal or metal alloy, on an article. In electrodeposition, as shown in prior art FIG. 6, an article 202 is placed in a tank 204 containing an appropriate deposition solution, such as electrolyte solution 206, which contains ions 208 of the metal to be deposited on the article 202. The article 202 forms a cathode or is in electrical contact with a cathode 210 which is immersed in the electrolyte solution 206. The cathode 210 is connected to a negative terminal 212 of a power supply 214. A suitable anode 216 is also immersed in the electrolyte solution 206 at an appropriate distance from the cathode 210 and is connected to a positive terminal 218 of the power supply 214. The power supply 214 generates an electrical current which flows between the anode 216 and the cathode 210 through the electrolyte solution 206. The electrical current causes an electrochemical reaction at the surface of the article 202 which results in the metal ions 208 in the electrolyte solution 206 being deposited on the article 202.

With semiconductor components, it is desirable to deposit the metal film with a uniform thickness across the article and with uniformity of composition of the metal(s) and/or other compounds forming the metal film. However, the electrodeposition process is relatively complex and various naturally occurring forces may result in a degradation in the electrodeposition process. The electrical current or flux path between the anode and the cathode should be uniform without undesirable spreading or curving to ensure uniform deposition. Additionally, since the metal ions in the deposition solution are deposited on the article, the deposition solution becomes depleted of metal ions which degrades the electrodeposition process. Therefore, suitable controls are required to introduce metal ions into the deposition solution in order to maintain consistency.

U.S. Pat. No. 5,516,412, issued May 14, 1996 to Andricacos et al. (the '412 patent), relates to an electrodeposition cell having a rack for vertically supporting a silicon substrate to be electrodeposited. A paddle is disposed within the electrodeposition cell for agitating an electrolyte solution within the cell to maintain a uniform distribution of deposition material within the electrolyte solution. Furthermore, the '412 patent teaches that the rack can be designed to be removable for automated handling. Although the '412 patent addresses the control issues discussed above, the rack assembly disclosed is not conducive to high-volume manufacturing. Furthermore, the '412 patent does not teach or suggest any means for improving the deposition on the silicon substrate by the movement of either the anode or cathode.

U.S. Pat. No. 4,696,729, issued Sep. 29, 1987 to Santini, and U.S. Pat. No. 5,198,089, issued Mar. 30, 1993 to Brueggman, both relate to an electrodeposition cell having a cathode assembly which is vertically mounted and holds a plurality of semiconductor substrates to be coated, and an anode which is also vertically mounted adjacent to the cathode assembly. The deposition solution is pumped upward between the anode and the cathode to produce a laminar flow across the surface of each wafer. However, both patents lack a means for insuring uniform distribution of deposition material within the deposition solution.

Systems which can be used for electrodeposition can also be used for electropolishing and electroetching. For example, U.S. Pat. No. 5,096,550, issued Mar. 17, 1992 to Mayer et al. (the '550 patent), teaches attaching an article to a rotating anode positioned horizontally face down in a polishing or etching bath. However, the '550 patent teaches only the motion of the cathode and since the articles are attached one at a time in the anode, the apparatus of the '550 patent is not conducive to high-volume manufacturing.

In most electrodeposition techniques, the wafers are attached to the cathode. The attachment of the wafers to the cathode can lead to significant problems, especially as the wafer quantities are increased within a single batch, such as control of the thickness of the material on the wafer. The problem of material thickness control is brought about by the non-uniformity of metal ions and less uniform current density in the electrolyte solution.

It is desirable to provide highly uniform thickness and composition of deposition material on an electrodeposited article or to uniformly polish or etch an article. Furthermore, it is also desirable to do so in an apparatus capable of high-volume manufacturing, preferably using automated handling equipment.

SUMMARY OF THE INVENTION

The apparatus of the present invention may comprise a housing tank containing a reaction solution, such as a deposition solution (e.g., an electrolyte solution). A moving cathode travels through a hollow anode which are both immersed in the reaction solution. The hollow anode is in electrical communication with a positive terminal of a power supply. The cathode is in electrical communication with a negative terminal of the power supply. The hollow anode is preferably a rotatable wire mesh cylinder which is rotated by a variable speed and direction motor. The wire mesh allows the reaction solution to flow through the anode. The rotation of the hollow anode agitates and mixes the reaction solution to maintain a uniform distribution of deposition material, etching material, or polishing material within the reaction solution. It is, of course, understood that the hollow anode can be any perforated metal structure, such as a thin sheet of metal, with a plurality of holes drilled therethrough. The rotation also prevents any dead spots on the anode from affecting the uniformity. Dead spots are considered as points where a complete electrical path between the anode and the cathode is not possible due to contamination or other imperfections on the anode.

The moving cathode is preferably a continuously moving structure to which the semiconductor substrates are mounted. The moving cathode is preferably a belt, interlinked moving housings on a cabling system, or the like. The moving cathode includes a plurality of article retainers, such as clips, for retaining the semiconductor substrates. It is preferred that the semiconductor substrates are mounted to the moving cathode mounting surface such that they are vertical or face downward so that debris from the electroplating (as well as electroetching or electropolishing) reaction does not build up on and contaminate the semiconductor substrates. Most preferably, the moving cathode has multiple moving surfaces which move in a corkscrew path, so that semiconductor substrates pivot about the radius of the cathode to prevent debris from the electroplating reaction from contaminating the semiconductor substrate surfaces.

The present invention is also useful for electrophoretic deposition, such as discussed in U.S. Pat. No. 3,714,011, issued Jan. 30, 1973 to Grosso et al. (electrophoretic deposition of cathodoluminescent material), and U.S. Pat. No. 4,592,816, issued Jun. 3, 1986 to Emmons et al. (electrophoretically depositing a photosensitive polymer composition on a conductive substrate), photoresist deposition, cleaning/polishing surfaces, or etching surfaces, such as discussed in U.S. Pat. No. 5,096,550, issued Mar. 17, 1992 to Mayer et al. In cleaning/polishing and etching of semiconductor substrates, the solution in which the semiconductor substrates are immersed may react in the presence of the electrical current and heat to activate an electrochemical reaction on the semiconductor substrate for cleaning or etching. Of course, with cleaning/polishing and etching of a semiconductor, the anode becomes the cathode and vice versa by switching the electrical connectors. In etching, the semiconductor substrate may be etched by any conventional etching techniques, such as masking the semiconductor substrate and inserting the semiconductor substrate into the apparatus for etching down to etch stops on the semiconductor substrate.

The controllable parameters of apparatus of the present invention may be monitored and controlled by a variety of means. The concentration of the reaction material and pH level in the reaction solution may be monitored by sensors and controlled by adding additional reaction material and/or acid/base to maintain said concentration and PH levels, respectively. The temperature of the reaction solution may be monitored and adjusted with a heat or cooling source within or adjacent to the reaction solution. The flux path between the anode and the cathode may be monitored and adjusted by varying the voltage from the power supply to the anode and the cathode. Also, electrical conductive surfaces to be plated can be tied together electrically to enable coating to be achieved on the various patterns that are otherwise isolated and would require an individual electrical bias.

The present invention achieves a highly uniform thickness and composition of deposition material on an article, and may also be used to achieve a uniform etch or polish on an article.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Although the present invention can be used for electrodeposition, etching, or polishing, the following description focuses on electrodeposition. It is, of course, understood that one skilled in the art can apply the teachings to etching, polishing, or the like.

Figure 1:
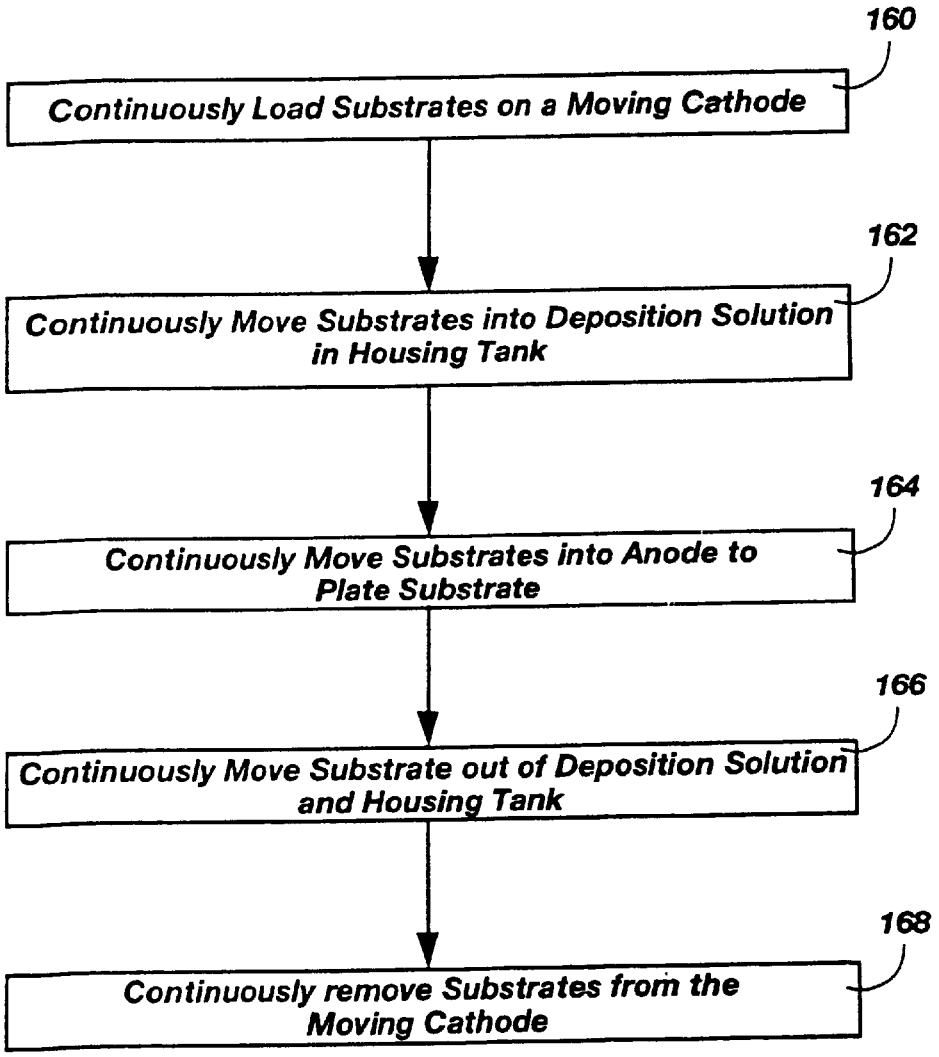
FIG. 1 is a flow diagram of a process of the present invention.

FIG. 1 illustrates a flow diagram of the steps of a general method of the present invention wherein substrates are continuously loaded on a moving cathode 160. The moving cathode continuously moves the substrates into deposition solution in a housing tank 162. The substrates are continuously moved into an anode to plate the substrates 164. The plated substrates are continuously moved out of the deposition solution and housing tank 166. Lastly, the substrates are continuously removed from the moving cathode 168.

Figure 2:
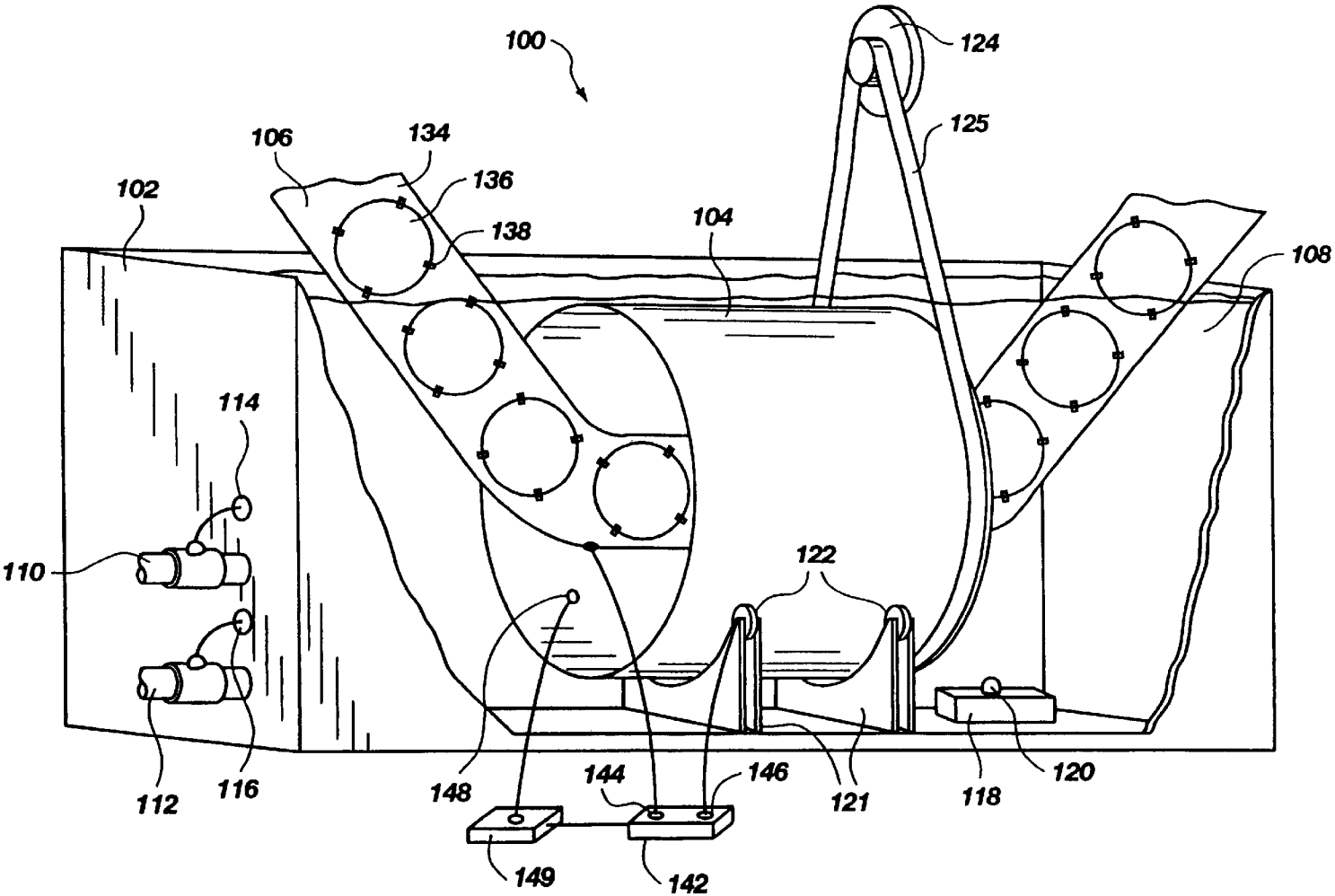
FIG. 2 is an oblique, cut away view of an embodiment of the electroplating apparatus of the present invention.

FIG. 2 illustrates an electrodeposition apparatus 100 according to one embodiment of the present invention. The electrodeposition apparatus 100 comprises a housing tank 102 with a hollow electrode, specifically a hollow anode 104, disposed therein and a moving second electrode, specifically a moving cathode 106, traveling through the hollow anode 104.

The housing tank 102 contains a deposition solution 108 in which the hollow anode 104 is immersed and the moving cathode 106 is partially immersed. The housing tank 102 is preferably made from a material which is non-conductive and does not interact with the deposition solution 108, such as poly(methyl-methacrylate) or polypropylene, and preferably can be opened or closed from a top surface.

The housing tank 102 preferably includes at least one deposition solution feed line 110 and at least one acid feed line 112. The deposition solution feed line 110 is preferably connected to at least one deposition solution concentration sensor 114 which monitors the concentration of the deposition material (e.g., metal ions) in the deposition solution 108. When the deposition material in the deposition solution 108 becomes depleted below a predetermined deposition material concentration, the deposition solution concentration sensor 114 will activate the deposition solution feed line 110 which is connected to a deposition material rich solution source (not shown) to feed the rich solution into the housing tank 102 to maintain the predetermined deposition material concentration. The acid feed line 112 is preferably connected to at least one pH sensor 116 which monitors the pH of the deposition solution 108. When the pH of the deposition solution 108 varies from a predetermined pH level, the pH sensor 116 will activate the acid feed line 112 which is connected to an acid solution source (not shown) to feed acid into the housing tank 102 to maintain the predetermined pH level. It is, of course, understood that the acid feed line can be a base feed line, depending on the conditions which are required to facilitate the electrochemical reaction.

The housing tank 102 preferably has a heat source 118 such as a heat exchanger, electric heating element, or the like, within or adjacent to the deposition solution 108. The heat source 118 is preferably connected to a temperature sensor 120, such as a thermistor or the like, which monitors the temperature of the deposition solution 108. When the temperature of the deposition solution 108 varies from a predetermined temperature level, the temperature sensor 120 will activate the heat source 118, which will heat the deposition solution 108 to maintain the predetermined temperature. Ideally, the temperature sensor 120 should be positioned away from the heat source 118 in order to sense a more accurate temperature representation of the deposition solution 108. It is, of course, understood that the location of the temperature sensor 120 can vary to enhance sensitivity. It is, of course, also understood that the heat source 118 can be a cooling mechanism depending on the temperate conditions which are required to facilitate the electrochemical reaction.

The hollow anode 104 is preferably a hollow cylinder which is rotatable. The hollow anode 104 preferably rotatably engages the housing tank 102 via stabilizing frames 121 with rotating members 122, such as a ball bearing or the like. The hollow anode 104 is in contact with a rotation mechanism 124, such as a variable speed and direction motor, by gears, pulleys, belts, or the like (shown in FIG. 2 as a belt 125). Thus, via the rotation mechanism 124, the hollow anode 104 can be rotated in clockwise, counter-clockwise, or back and forth arcuate motion ("washing machine" motion). This motion assists in agitating and mixing the deposition solution 108 to maintain a uniform distribution of deposition material within the deposition solution 108. The rotation of the hollow anode 104 eliminates the necessity of a paddle (as required in most prior art assemblies) to mix the deposition solution 108. The speed of the rotation mechanism 124 is preferably adjustable, such that the speed of rotation of the hollow anode 104 can be manually adjusted or controlled by an automatic controller (not shown).

Figure 3:
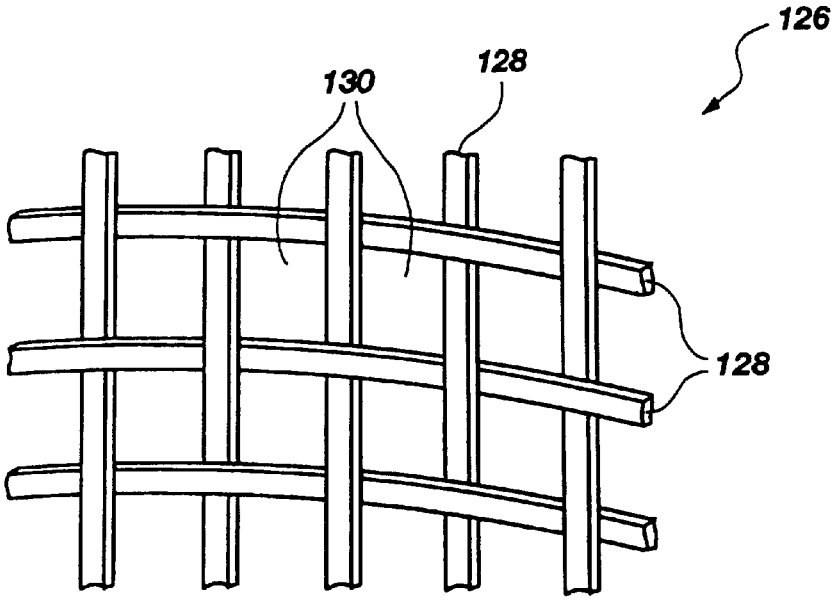
FIG. 3 is an oblique, cut away view of an anode wire mesh embodiment of the present invention.

The hollow anode 104 is preferably fabricated from wire mesh 126, as shown in FIG. 3. In metal deposition, the wire mesh 126 is preferably formed of the same metal as the metal to be deposited on the semiconductor substrate. For example, if copper metal is to be deposited on the semiconductor substrate, then the wire mesh 126 should be made of pure copper or copper with a minor additive, such as 5% phosphorous, to improve grain size control on the semiconductor substrate.

Figure 4:
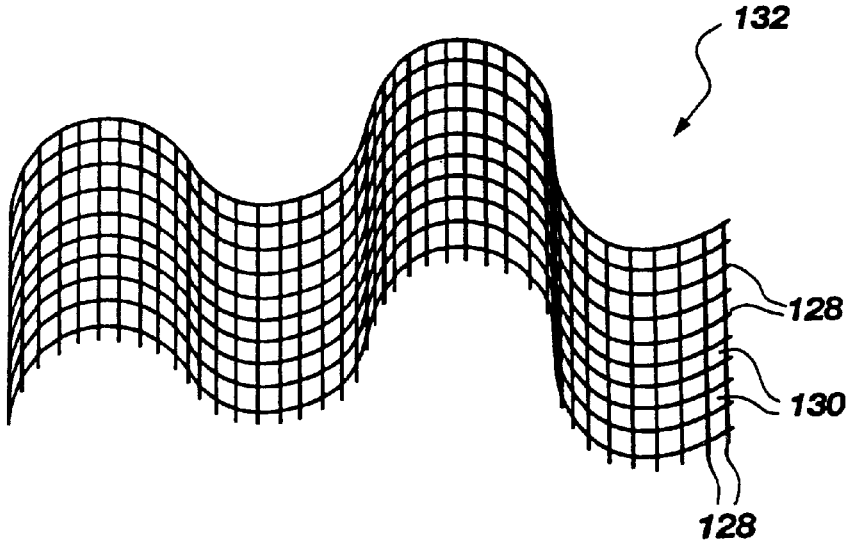
FIG. 4 is an oblique, cut away view of a corrugated anode wire mesh embodiment of the present invention.

In an embodiment for coating 6 inch silicon wafers, a square mesh wire 128, preferably 1 mil thick, is woven to form square mesh windows 130 (i.e., the open space between the woven wire) of up to ¼ inch per side. However, it has been found that varying the size of the mesh windows affects the deposition characteristics of the material deposited on the semiconductor substrate. Simple square or circular mesh is preferred. For example, a denser mesh can lead to a higher deposition rate, but allows for less electrolyte solution to pass through the mesh. The anode wire mesh 126 maybe formed to have an irregular shape, such as a corrugated shape 132, shown in FIG. 4. The corrugations preferably run parallel with the length of the moving cathode 106. An irregular shape assists in more effective mixing of the deposition solution 108 during the rotation of the hollow anode 104. However, the irregular shape must not be so substantial that sufficient turbulence is generated during the rotation of the hollow anode 104 to disturb the deposition of material on the moving cathode 106. Furthermore, sharp protrusions are avoided on the mesh as they can also cause turbulence which can lead to non-uniform deposition.

The moving cathode 106 is preferably a continuously moving structure to which the semiconductor substrates 136 are mounted. The moving cathode 106 is preferably a belt, interlinked moving housings on a cabling system, or the like. The moving cathode 106 has at least one mounting surface 134 for mounting semiconductor substrates 136 or metal coated substrates 136, as shown in FIG. 2. The substrates 136 are also in electrical communication with the moving cathode 106 to complete the electrical circuit. The moving cathode 106 further includes a plurality of article retainers 138, such as clips, slide-on retainers, or the like, for retaining the semiconductor substrates 136 on the moving cathode mounting surface 134. The article retainers 138 could also make electrical contact to the front side of the semiconductor substrates 136. It is preferred that the semiconductor substrates 136 are mounted to the moving cathode mounting surface 134 such that they are vertical (as shown in FIG. 2) or face downward so that any debris from the electroplating, electroetching, or electropolishing reaction does not build up on and contaminate the semiconductor substrates 136.

Figure 5:
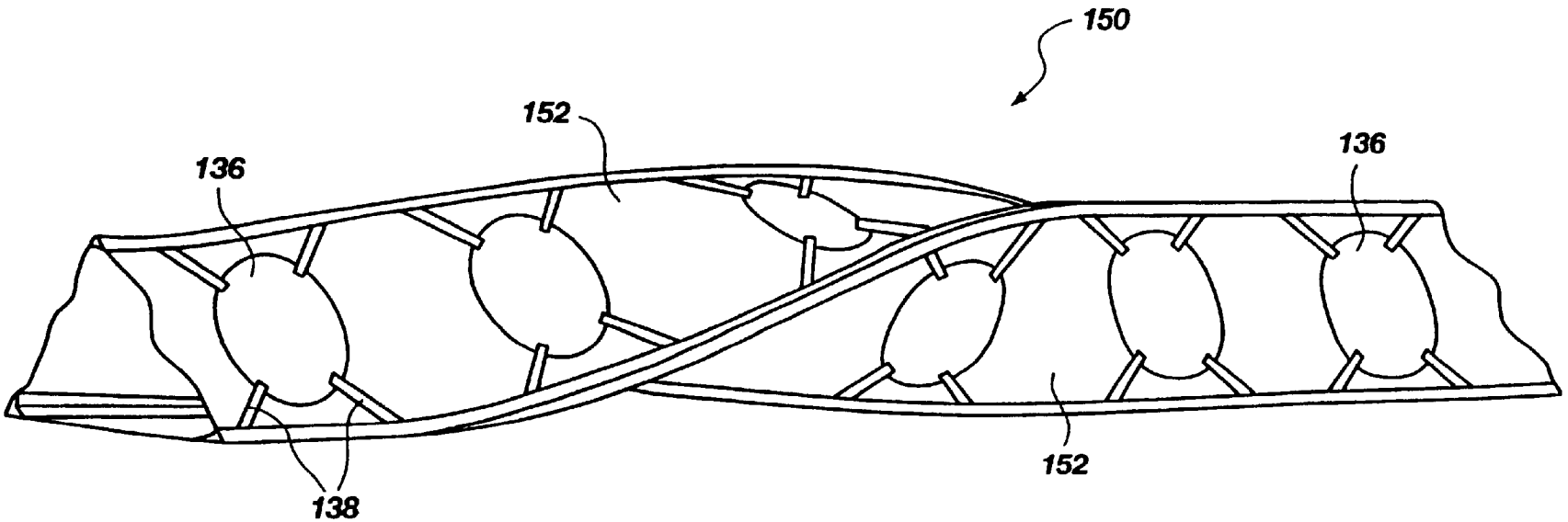
FIG. 5 is an oblique, cut away view of a cathode of another embodiment of the electroplating apparatus of the present invention.
Figure 6:
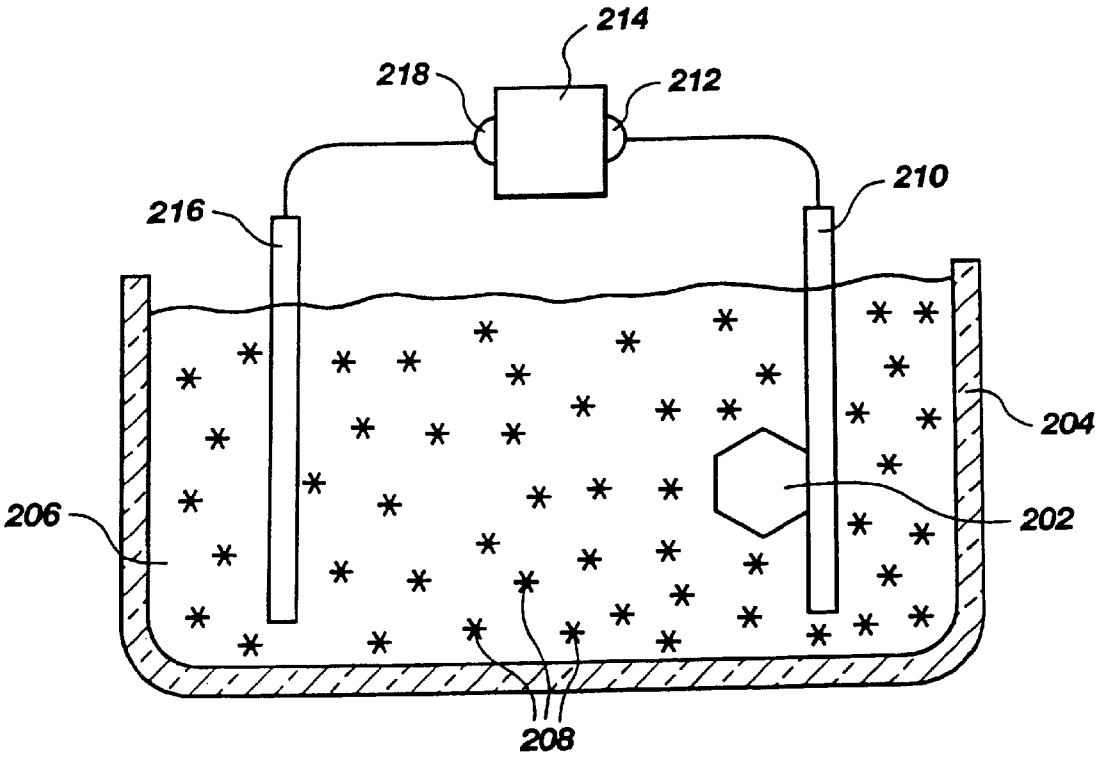
Fig. 6 (PRIOR ART)
FIG. 6 is a prior art electroplating apparatus.

Most preferably, as shown in FIG. 5, the moving cathode 106 may be a multi-sided moving cathode 150 configured with any cross-sectional shape, such as triangular (shown), rectangular, pentagonal, hexagonal, and so on. The multi-sided moving cathode 150 may have a plurality of multiple moving surfaces 152 which move in a corkscrew path, so that semiconductor substrates 136 pivot about the radius of the multi-sided moving cathode 150 to prevent debris from the electroplating reaction from contaminating the semiconductor substrates 136.

The multi-sided cathode 150 may be constructed of belts, interlinked moving housings on a cabling system, or the like, to which the semiconductor substrates 136 are attached. The multi-sided cathode 150 includes a plurality of article retainers 138, such as clips, for retaining the semiconductor substrates 136 on the moving surfaces 152. It is, of course, understood that the multi-sided cathode 150 could be designed to rotate either in an opposing or a common direction of the hollow anode's 104 rotation.

As shown in FIG. 2, the hollow anode 104 is in electrical communication with a positive terminal 146 of a power supply 142 (shown as electrically communicating through a rotating member 122) and the moving cathode 106 is in electrical communication with a negative terminal 144 of the power supply 142 (shown as a general connection rather than a function connection). It is, of course, understood that the polarity of the anode and the cathode can be reversed, depending on the metal ions that are being deposited. Negative ions are typically attracted to positive surfaces and vice versa. At least one flux sensor 148 is preferably placed in the deposition solution 108 between the hollow anode 104 and the moving cathode 106 to monitor the flux path between the hollow anode 104 and the moving cathode 106. The flux sensor 148 is connected to a voltage controller 149 which is, in turn, in electrical communication with the power supply 142. The voltage controller 149 controls the voltage from the power supply 142 to the hollow anode 104 and the moving cathode 106 such that the flux path is maintained at a predetermined set point.

Depending on the interrelationship of the controllable variables in the system (i.e., temperature, anode rotation speed, pH, voltage, etc.), a control scheme could be used to interrelate the respective variable controllers.

When the apparatus of the present invention is used for cleaning/polishing and etching of semiconductor substrates, the anode generally becomes the cathode and vice versa by switching the electrical connectors. The solution in which the semiconductor substrates are immersed reacts in the presence of the electrical current and heat to activate an electrochemical reaction on the semiconductor substrate for cleaning or etching. In etching, the semiconductor substrate may be etched by any conventional etching techniques, such as masking the semiconductor substrate and inserting the semiconductor substrate into the apparatus for etching down to etch stops on the semiconductor substrate.

It is believed that the present invention achieves uniformity in product by evenly distributing any variance across all of the semiconductor substrates in the reaction solution. The rotation of the anode creates the same flux path across all of the semiconductor substrates as well as mixes the reaction solution. The mixing of the reaction solution evenly distributes any variation in reaction material concentration, temperature, and/or pH of the reaction solution across all of the semiconductor substrates. This mixing is believed to result in a consistent deposition, etch, or polish on all of the semiconductor substrates.

Having thus described in detail preferred embodiments of the present invention, it is to be understood that the invention defined by the appended claims is not to be limited by particular details set forth in the above description as many apparent variations thereof are possible without departing from the spirit or scope thereof.

What is claimed is:

1. A method of processing semiconductor substrates, comprising:

disposing a hollow first electrode within a chamber;

providing a second electrode configured to removably retain and electrically communicate with at least one semiconductor substrate, the second electrode configured to be moved through the hollow first electrode;

disposing a reaction solution within the chamber;

providing an electrical power source to be communicated with the hollow first electrode and the second electrode;

engaging at least one semiconductor substrate with the second electrode; and immersing the at least one semiconductor substrate in the reaction solution within the chamber and moving at least a portion of the second electrode through the hollow first electrode while communicating the electrical power source with the hollow first electrode and the second electrode.

2. The method of claim 1, further comprising communicating the electrical power source so that the hollow first electrode serves as an anode and the second electrode serves as a cathode.

3. The method of claim 1, further comprising communicating the electrical power source so that the hollow first electrode serves as a cathode and the second electrode serves as an anode.

4. The method of claim 1, further comprising rotating at least a portion of the second electrode within the hollow first electrode.

5. The method of claim 4, further comprising rotating the second electrode to move the at least one semiconductor substrate in a substantially corkscrew path.

6. The method of claim 1, further comprising providing the hollow first electrode with an irregular surface.

7. The method of claim 1, further comprising providing the hollow first electrode with a plurality of perforations.

8. The method of claim 1, wherein providing the hollow first electrode comprises forming at least a portion of the hollow first electrode from a wire mesh.

9. The method of claim 8, further comprising providing the hollow first electrode with an irregular surface.

10. The method of claim 8, further comprising providing the hollow first electrode with a corrugated surface.

11. The method of claim 1, further comprising providing a rotation mechanism adapted to operationally engage the hollow first electrode to rotate the hollow first electrode about the second electrode.

12. The method of claim 1, further comprising rotating the hollow first electrode about the second electrode.

13. The method of claim 1, wherein providing the second electrode comprises providing the second electrode with multiple sides, each side of the multiple sides adapted to engage at least one semiconductor substrate.

14. The method of claim 1, further comprising providing the second electrode with at least one article retainer for engaging the at least one semiconductor substrate.

15. The method of claim 1, further comprising monitoring a flux path between the hollow first electrode and the second electrode while communicating the electrical power source with the hollow first electrode and the second electrode.

16. The method of claim 1, further comprising monitoring a pH level of the reaction solution.

17. The method of claim 1, further comprising heating the reaction solution.

18. The method of claim 17, further comprising maintaining the reaction solution within a preselected temperature range.

19. The method of claim 1, wherein disposing the reaction solution comprises disposing a reaction solution including at least one of a deposition material, a conductive material, a metal conductive material, ions of a metal, a photoresist material, an electrophoretic material, an etching material, or a polishing material.

20. The method of claim 1, further comprising providing a processing control scheme dependent on at least one controllable processing variable.

21. The method of claim 20, wherein providing the processing control scheme comprises providing a processing control scheme based on controlling at least one controllable processing variable selected from the group consisting of reaction solution temperature, reaction solution pH, electrical power, and electrode motion speed.

22. The method of claim 1, further comprising controlling processing of the at least one semiconductor substrate based upon a value of at least one controllable processing variable.

23. The method of claim 22, wherein controlling processing of the at least one semiconductor substrate comprises controlling the processing of the at least one semiconductor substrate based upon a value of at least one controllable processing variable selected from the group consisting of reaction solution temperature, reaction solution pH, electrical power, and electrode motion speed.

24. The method of claim 1, further comprising controlling processing of the at least one semiconductor substrate by monitoring and controlling at least one controllable processing variable.

25. The method of claim 24, wherein monitoring and controlling the at least one controllable processing variable comprises monitoring and controlling at least one controllable processing variable selected from the group consisting of reaction solution temperature, reaction solution pH, electrical power, and electrode motion speed.

* * * * *